United States Patent [19]

Abraham

[11] 4,389,852

[45] Jun. 28, 1983

[54] ONE AND A HALF BAND REFRIGERATED DISPLAY CASE

[75] Inventor: Fayez F. Abraham, Niles, Mich.

[73] Assignee: Tyler Refrigeration Corporation, Niles, Mich.

[21] Appl. No.: 124,544

[22] Filed: Feb. 25, 1980

Related U.S. Application Data

[63] Continuation-in-part of Ser. No. 76,669, Sep. 18, 1979, which is a continuation-in-part of Ser. No. 60,459, Jul. 25, 1979, and Ser. No. 70,882, Aug. 29, 1979.

[51] Int. Cl.[3] ..... A47F 3/04

[52] U.S. Cl. ..... 62/82; 62/256

[58] Field of Search ..... 62/255, 256, 80, 82, 62/282

[56] References Cited

U.S. PATENT DOCUMENTS

| | | | |
|---|---|---|---|
| 3,289,432 | 12/1966 | Brennan et al. | 62/256 |
| 3,365,908 | 1/1968 | MacMaster | 62/256 |
| 3,690,118 | 9/1972 | Rainwater | 62/256 X |
| 3,827,254 | 8/1974 | MacMaster et al. | 62/256 |
| 4,026,121 | 5/1977 | Aokage et al. | 62/256 X |

*Primary Examiner*—William E. Tapoicai

*Attorney, Agent, or Firm*—LeBlanc, Nolan, Shur & Nies

[57] ABSTRACT

A refrigerated display case for displaying refrigerated products. The display case is formed in a cabinet that has an interior area for holding the refrigerated products. The cabinet has an access opening for enabling access to the refrigerated products. A first air conduit extends around the cabinet and has inlet and outlet air openings for directing air across the access opening in the cabinet. During a refrigeration cycle of operation, the air traveling through the first air conduit is refrigerated by a set of evaporator coils. A second air conduit extends partially around the cabinet along a path lying outwardly of the first air conduit. The second air conduit has an outlet opening positioned adjacent to the outlet opening of the first air conduit. During the refrigeration cycle, partially cooled air is emitted from the outlet opening of the second air conduit along a path across the access opening of the cabinet but lying outwardly of the air emitted from the outlet opening of the first air conduit. The inlet opening of the second air conduit is positioned so that a portion of the air passing through the air circulating mechanism travels directly into the second air conduit and another portion of such air travels over a part of the evaporator coils before entering the second air conduit. The display case can be operated either in a refrigeration mode of operation where the air is circulated in a forward direction through the first and second air conduits with the air passing through the first conduit being refrigerated or a defrost mode of operation where ambient air is circulated through the first and second air conduits in a reverse direction. During the defrost mode of operation, ambient air is drawn through the outlet openings into the first and second air conduits. The ambient air passing through the second air conduit helps to transfer heat to the air passing through the first air conduit and to the evaporator coils both by means of conduction and convection so as to assist in the defrosting of the evaporator coils.

38 Claims, 5 Drawing Figures

ONE AND A HALF BAND REFRIGERATED DISPLAY CASE

RELATED APPLICATIONS

The present application is a continuation-in-part of application Ser. No. 76,669 entitled ONE AND A HALF BAND REFRIGERATED DISPLAY CASE; filed Sept. 18, 1979 which is a continuation-in-part of applications Ser. No. 60,459 entitled OPEN TOP REFRIGERATED DISPLAY CASE HAVING AMBIENT AIR DEFROST, filed July 25, 1979 and Ser. No. 70,882, entitled MULTIBAND OPEN FRONT REFRIGERATED CASE WITH AIR DEFROST, filed Aug. 29, 1979; these applications are hereby incorporated by reference. The present application is also related to patent application Ser. No. 25,350, entitled OPEN TOP REFRIGERATED DISPLAY WITH STORAGE SECTION, filed Mar. 30, 1979 in the names of Arthur Perez and Fayez Abraham; the contents of such application is hereby incorporated by reference.

BACKGROUND OF THE INVENTION

The present invention relates to refrigerated display cases having an ambient air defrost system, particularly to open front refrigerated display cases. Both within the specification and the claims of the present application, all references to refrigeration apparatus or refrigeration operations are intended to include cooling both at a temperature below 32° F., such as associated with frozen food display cases, and in excess of 32° F., such as typically associated with dairy food and fresh meat display cases.

A significant contribution to the refrigeration load in the operation of open display cases is created by heat and mass transfer through the air curtain of the display case. Since the heat transfer is dependent upon temperature differentials between adjacent bands of air to reduce this temperature differential. In addition to the heat transfer from the temperature differentials, transfer also occurs of the moisture from the high concentration of the ambient air of the store to the low concentration of the refrigerated air band. Typically, such problems have been at least partially addressed by the utilization of multi-band refrigerated display cases, with a separate set of fans for propelling air through each of the air conduits. In such multi-band refrigerated cases, the innermost air band is refrigerated, the secondary air band, while cooler than ambient air, is not refrigerated. A tertiary band is also typically utilized which propels a curtain of ambient air across the access opening of the display case.

In the operation of all types of refrigerated display cases, it is desirable to include a system capable of automatically defrosting the display case. The defrost cycle can be actuated either at set periodic times or when the frost buildup within the system has reached a certain predetermined level. Such systems are typically thermostatically controlled so as to switch from a refrigeration cycle to a defrost cycle of operation. By this manner of operation, it is possible to avoid any significant frost buildup within the display case.

Typically within the prior art, there have been three different approaches employed for defrosting refrigerated display cases. The first approach involves the use of electric resistance heaters which during a defrost cycle supply heat to eliminate the frost buildup on the coils. These heaters, however, add warmer air to the air conduit for circulation within the case. The particular technique is relatively simple body in its construction and operation. However, since the electrical heaters are high voltage heaters that utilize significant electricity during operation, with the rapidly increasing cost of electricity it has become extremely uneconomical to employ such systems. Furthermore, the warm air circulated in the case can raise the temperature of the case too high. Thus, attempts have been made to find other alternatives to such a system.

A second type of system circulates hot compressed gaseous refrigerant through the refrigeration coils during the defrost cycle. During the defrost cycle, a valve control mechanism shuts off the supply of refrigerant to the refrigeration coils and alternatively feeds superheated compressed gaseous refrigerant through the coils. This hot gas serves to melt any frost buildup that has occurred on the refrigeration coils but simultaneously provides heat within the air conduit which can be circulated through the display case, which again is disadvantageous. Due to the requirement that the system be able to selectively switch between the supply of heated gas and refrigerant to the refrigeration coils, a complicated valving structure must be provided.

The third type of system employed for defrosting display cases relies upon ambient air. It is this general category with which the invention of the present application is concerned. One type of system that employs ambient air during the defrost cycle is exemplified by those embodiments illustrated in U.S. Pat. Nos. 3,403,525; 3,850,003 and 3,937,033, all to Beckwith, et al. Each of these systems uses fans separate from the main air circulating fans. These extra fans are turned on during the defrost cycle for pulling ambient air from outside of the display case into the air conduits. A second type of system is illustrated in U.S. Pat. No. 3,082,612 to Beckwith, which system draws ambient air into the main circulation path through ports located in the lower front panel of the refrigerated display case. Such ports are normally closed during the refrigeration cyle and are opened during the defrosting cycle. The Beckwith, et al. '003 patent indicates that the concepts described in U.S. Pat. Nos. 3,082,612 and 3,403,525 did not prove to be practical and hence were not commercially feasible.

Finally, a third type of ambient air defrosting system is shown in U.S. Pat. No. 4,144,720 to Subera, et al., which is assigned to the same assignee as the present application. In the foregoing patent application, an open front refrigerated display case having primary and secondary air conduits is disclosed. In this system, reversible fans are employed for reversing the direction of flow of air within the conduits and simultaneously drawing in air from outside of the display case.

Another system employing reversible fans for ambient air defrost is shown in U.S. Pat. No. 4,026,121. This patent, however, refers to short-circuiting the air flow between the primary and secondary air bands for the purpose of supplying warmer air to the primary band.

It has been recognized that an ambient air defrost operation can be incorporated into an open top refrigerated display case as disclosed in U.S. Pat. No. 4,120,174 to Johnson. The Johnson patent illustrates an open top case having a single air conduit extending around the case. During the refrigeration cycle, the air flows in a first direction and during the defrost cycle the direction of the air flow is reversed with ambient air being drawn into the conduit. The quantity of air flow during the defrost cycle is greater than during refrigeration. The defrost air, after passing through the conduit, is expelled in a direction up and over the refrigerated case.

During the defrost operation, as the ambient air passes through the air conduit containing the evaporator coils such air is initially cooled by the frost buildup that exists on the coils. In addition, the air flow is significantly restrained since the openings between the coils are often substantially blocked. While in the multiband display cases the ambient air passing through the second air conduit that encircles the case helps in the defrost operation, such a secondary air conduit requires the utilization of additional fans for circulating the air as well as additional materials for purposes of construction. Consequently, both the single band and multiband display cases have certain inherent drawbacks and it, therefore, has been necessary to make a tradeoff in efficiency and costs between the two types of display cases.

Display cases having a full primary air conduit in which the evaporator coils are located and a partial secondary air conduit have been previously known; see for example U.S. Pat. Nos. 3,690,118 to Rainwater and 3,827,254 to MacMaster et al. The partial secondary conduit has been utilized in order to provide a protective air curtain across the access opening for insulating the primary air curtain established by the refrigeration air conduit from the ambient air outside of the display case. Such display cases, however, have typically utilized electric defrost techniques for defrosting the evaporator coils. While a secondary protective screen is provided, there has been very little, if any, known advantages to the utilization of such a display case with respect to the resulting efficiency of operation.

SUMMARY OF THE INVENTION

An object of the present invention is to provide an improved refrigerated display case.

Another object of the present invention is to provide an improved refrigerated display case in which a secondary protective air screen is provided across the access opening without the requirement of a separate set of fans.

A further object of the present invention is to provide an improved refrigerated display case in which a secondary air curtain having a temperature and moisture gradient through it.

Still another object of the present invention is to provide a method for reducing the heat and mass transfer to the refrigerated air curtain by providing a plurality of air curtains with a gradual change in temperature and moisture levels thereby reducing the refrigeration load and power consumption of the display case.

Still another object of the present invention is to provide an improved refrigerated display case in which a secondary protective air screen is provided across the access opening without the requirement of a separate set of fans and which utilizes an ambient air defrost operation.

A still further object of the present invention is to provide an improved refrigerated display case in which additional ambient air can be drawn into the air conduit surrounding the case for assisting in the defrosting of the evaporator coils without any requirement for an additional set of fans.

Still another object of the present invention is to provide a refrigerated display case having a primary refrigerated air conduit circling the case and a partial secondary air conduit wherein during a defrost operation ambient air passes through both air conduits and the ambient air passing through the secondary conduit transfers heat to the air passing through the first air conduit by convection and conduction.

Still a further object of the present invention is to provide a one and a half band refrigerated display case utilizing an ambient air defrost operation.

A still further object of the present invention is to provide an improved one and a half band refrigerated display case utilizing an ambient air defrost operation and operating with increased efficiency.

These objectives can be achieved by the utilization of a one and a half band refrigerated display case in accordance with the present invention. In the one and a half band refrigerated display case of the present invention, a portion of the air entering the secondary air conduit is refrigerated. Since the air flowing through the conduits typically flow in a laminar flow path it is possible to create a temperature and moisture gradient in the air flow through the partial secondary air conduit.

During the operation of a typical medium temperature refrigerated display case, the refrigerated air curtain has a temperature in a range of 24° to 34° F., e.g. 30° F., and the store ambient temperature level is approximately 70° F., thereby resulting in a temperature differential of 40° F. Since the load of the display case is dependent upon the differential between adjacent bands of air, the efficiency of the case can be improved by decreasing the temperature differential. For this purpose, a secondary air band can be used which would have a temperature of about 50° F. If an ambient air band is also utilized, this temperature differential is further reduced. By utilizing the partial secondary air band of the present invention which is arranged for receiving air which has passed through a portion of the evaporator coils, the inner layer portions of the secondary air bands will be approximately 40° F. while the outer layers of the secondary air band will be approximately 50° F. If an ambient air band is utilized, its temperature will be about 70° F. Thus, in such an embodiment, the air gradient of the air curtains will be as follows: 70° F.—50° F.—40° F.—30° F. If the store ambient air is a temperature of approximately 70° F., then the temperature differential between adjacent layers of air between the store ambient air and the refrigerated air curtain will be minimal which will thereby minimize the heat transferred by convection to the inner refrigerated air band of the display case.

The mass transfer in the operation of the display case depends on the differential in the moisture concentration between the ambient air of the store and the air curtain and in particular depends upon the gradient differential. For example, in the operation of a typical medium temperature refrigerated display case, the refrigerated air curtain has a temperature of 30° F. and a moisture level of 0.0034 lbs. $H_2O$/lb. dry air and the ambient air has a temperature of 75° F. with a moisture level as high as 0.01 lbs. $H_2O$/lb. dry air. The moisture concentration differential in this case is 0.0066 lb. $H_2O$/lb. dry air. This differential between adjacent layers of air can be reduced with running a secondary air band at 50° F. and 0.007 lb. $H_2O$/lb. dry air to a differential of 0.003 lb. $H_2O$/lb. dry air, i.e. the differential can be reduced by half. The differential can be further reduced by having a portion of the second air band running at 40° F. with a moisture content of 0.0046 lb. $H_2O$/lb. dry air. This further reduces the moisture differential by having a gradual gradient and thereby limits the amount of moisture which penetrates the air curtain. By so reducing the amount of moisture which does penetrate the air curtain, the refrigeration load is reduced. The display case is formed in a cabinet having an interior display space with an access opening for enabling access to refrigerated products within the display case. A first air conduit extends around the cabinet so as to have an outlet opening at one end of the access opening and an inlet opening at the other end of the access opening. The inlet and outlet openings of the first air conduit are aligned so that air leaving the outlet opening is directed across the access opening and received by the inlet opening. A refrigeration mechanism, which is formed by either a single evaporator coil or a set of evaporator coils, is arranged within the first air conduit for refrigerating the air passing through such conduit.

Air is circulated through the first air conduit by a set of fans. The number of fans depends on the lateral length of the conduit and the sizes of the fans. Typically, two fans are used for an eight foot long case and three fans for a twelve foot long case. The air is circulated through the first air conduit in a forward direction during a refrigeration cycle of operation so that air is expelled from the outlet opening, travels across the access opening and then returns into the first air conduit through the inlet opening. During a defrost cycle of operation, the air is circulated through the first air conduit in a reverse direction so that the air is expelled from the inlet opening.

A second air conduit extends partially around the cabinet in a position lying outwardly of the first air conduit. The second air conduit has an outlet opening arranged adjacent to the outlet opening of the first air conduit. A partition wall separates the first and second air conduits. This partition wall is arranged so that a portion of the evaportor coils is located forward of the inlet opening of the second air conduit. The second air conduit has an air inlet opening located so as to open into the first air conduit in order that during a refrigeration cycle of operation such inlet opening receives air passing through the first air conduit and also receives along its inner wall partially cooled air that has passed through a portion of the refrigeration mechanism. The air passing through the partial second air conduit has both a temperature and moisture gradient. The entire secondary air band is cooler than the ambient air since it has partially blended with the air in the portion of the first conduit before the fans. The laminar air flow along the inside of the second conduit, however, is even colder and has less moisture since such air flows over part of the evaporator coils.

A control mechanism switches the display case between a refrigeration cycle of operation and a defrost cycle of operation. During the defrost cycle of operation, the operation of the refrigeration mechanism is temporarily terminated and the fans serve to circulate air through the first air conduit in a reverse direction for causing ambient air to be drawn into the outlet openings of the first and second air conduits and circulated through such conduits.

The ambient air circulated through the second air conduit during a defrost cycle of operation serves to transfer heat to the air passing through the first air conduit for assisting in the defrosting of the evaporator coil. A portion of the ambient air flow through the second conduit also flows over the evaporator coils thereby aiding the defrosting operation. The heat transfer from the ambient air flow through the second conduit occurs both by conduction through the common wall shared by the first and second air conduit and by convention when the ambient air from the second air conduit mixes with the air passing through the first air conduit in the area between the fans and the evaporator coil.

The air flow through the first air conduit is partially restricted due to the existence of the evaporator coil within the conduit. Such restriction or resistance to the air flow exists even if there is no frost buildup on the evaporator coil. If the first and second air conduits both have the same cross sectional dimensions there would be a natural tendency for the air to flow in greater quantity through the second air conduit than the first air conduit during a refrigeration cycle of operation. In order to prevent this natural tendency and to provide a better balance of the air flow between the conduits, the first air conduit can be provided with a greater cross sectional area. In accordance with one preferred embodiment of the present invention, the cross sectional area of the first air conduit is three square feet while the cross sectional area of the second air conduit is two square feet. In order to provide additional resistance to the air flow through the second air conduit, a screen with a plurality of perforations can be provided within the second air conduit.

The first and second air conduits are constructed so that the volume of air flowing through the second air conduit during at least a portion of the defrost cycle of operation is greater than the volume of air flowing through the second air conduit during a refrigeration cycle of operation. In this manner, a greater quantity of ambient air passes through the air conduits than would otherwise be possible. In this regard, it must be taken into consideration that at the start-up of the defrost cycle of operation the accumulation of frost on the evaporator coils significantly restricts the air flow through the first air conduit thereby causing the volume of such air flow to be extremely diminished.

During the refrigeration cycle of operation, the volume of air flowing through the second air conduit should be approximately one-third of the volume of air flowing through the first air conduit. During the defrost cycle of operation, on the other hand, the volume of air flowing through the second air conduit should be at least one-half of the volume of air flowing through the first air conduit.

DESCRIPTION OF THE PREFERRED EMBODIMENTS

Figure 1:
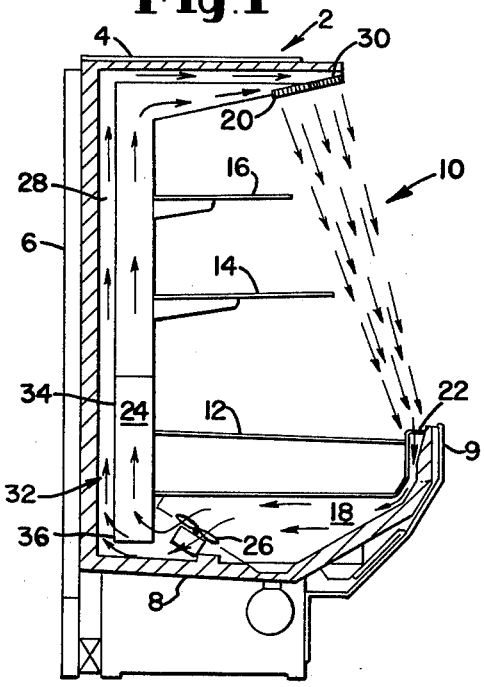
FIG. 1 is a side elevational partial sectional view of an open front refrigerated display case in accordance with the present invention with the case being operated in a refrigeration cycle of operation.

An open front refrigerated display case 2 is illustrated in FIG. 1. Display case 2 has a top wall 4, a rear wall 6, a bottom wall 8 and a front wall 9. An access opening 10 for enabling access to products within the display case is provided in front wall 9. Within the display case are a plurality of shelves 12, 14 and 16.

Display case 2 has a first air conduit 18 that extends around the display case and has an outlet opening 20 at one end of access opening 10 and an inlet opening 22 at the opposite end of access opening 10. A fan 26 mounted within conduit 18 circulates air through the conduit and through a set of evaporator coils 24 which are arranged within conduit 18. During a refrigeration mode of operation of display case 2, evaporator coils 24 are put into operation and fan 26 circulates air in a forward direction through conduit 18 so that such air passes through the evaporator coils so as to be refrigerated. The refrigerated air is then expelled from conduit 18 through outlet opening 20 so as to be directed across the access opening and received back into the conduit through inlet opening 22. In this manner, a continuous band of refrigerated air is circulated within the display case during the refrigeration mode of operation.

In addition to the refrigeration band circulated through air conduit 18, a partial secondary air band is also formed. This air band is formed within air conduit 28 that extends part way around the display case and lies outwardly of air conduit 18. Air conduit 28 has an inlet opening 32 and an outlet opening 30. Air conduit 28 is separated from air conduit 18 by a partition wall 34. Partition wall 34 only extends part way along evaporator coils 24 so that inlet opening 32 of air conduit 28 receives some air that has passed over a lower portion of evaporator coil 24.

Figure 1A:
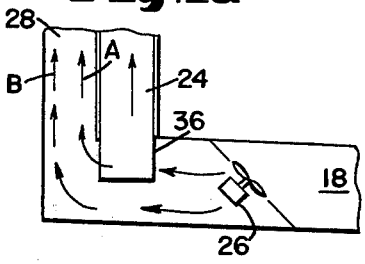
FIG. 1*a* is an enlarged view of a portion of FIG. 1.

The various air flow paths through display case 2 during the refrigeration mode of operation are shown in FIG. 1*a*. As shown, fan 26 propels air along conduit 18. The major portion of this air flows over the entire set of evaporator coils and up through air conduit 18 so as to be expelled from outlet opening 20. The remaining portion of the air flows through secondary conduit 28. Of the air flowing into the secondary conduit, there are two portions. The first portion flows through a lower part 36 of evaporator coils 24 and then into air conduit 28 so as to form the air flow designated as A. The second portion flows under the evaporator coils and directly into air conduit 28 so as to create the air flow designated as B. Since air flow A has flowed over part of the evaporator coils, the temperature of such air flow and also the moisture concentration of such air flow is lower than air flow B. Consequently a gradient both of temperature and moisture concentration is established within the air flow through air conduit 28.

Typically, in a medium case refrigerated display case, the air flow through the first air conduit, conduit 18, would have a temperature of approximately 30° F. The ambient air surrounding the display case is typically maintained at approximately 70° F. such a huge differential in the temperature of the ambient air and the refrigerated air band would create a large refrigeration load during the operation of the display case thereby decreasing the efficiency of such operation. In order to minimize the refrigeration load and improve the efficiency of the display case, the partial secondary band of air can be established. By utilizing a partial secondary band a protective air curtain between the refrigerated air band and the ambient air can be established without the necessity of utilizing a second set of fans. The typical partial secondary band will normally have a temperature of about 50° F. in a medium temperature refrigerated display case. In accordance with the present invention, a gradient is established in this partial secondary band. Consequently, the inner portion of the secondary band, portion A, has a temperature of approximately 40° F. while outer portion B has a temperature of approximately 50° F. In this manner, in the air flow across the access opening of the display case, the air flow pattern varies as follows: 70° F.—50° F.—40° F.—30° F. Such relatively small incremental step decreases between the ambient air and the refrigerated air significantly minimizes the refrigeration load and improves the efficiency of the operation of the refrigerated display case.

In addition to the temperature differential, another factor influencing the refrigeration load is the moisture concentration. The mass transfer depends on the moisture concentration difference between the store ambient and the refrigerated air curtain. Typically, in a medium temperature refrigerated display case running at 30° F. for the refrigerated air band, the moisture concentration is 0.0034 lbs. $H_2O$/lb. dry air with the ambient air being as high as 70°-75° F. with a moisture level of 0.01 lb. $H_2O$/lb. dry air. The moisture concentration difference in such a case is 0.0066 lb. $H_2O$/lb. dry air. By running a secondary air band with a temperature gradient varying from approximately 40°-50°, a moisture concentration varying from 0.0046 lbs. $H_2O$/lb. dry air to 0.007 lb. $H_2O$/lb. dry air, the moisture concentration differential between the adjacent layers of air can be significantly reduced. By reducing the moisture differential, the amount of moisture which penetrates from the ambient air to the refrigerated air band is also reduced thereby serving to minimize the refrigeration load and improving the efficiency of operation of the display case.

Figure 2:
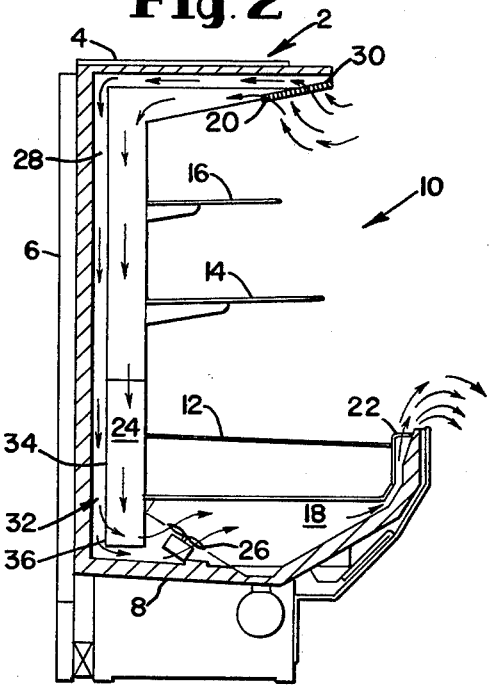
FIG. 2 is a view similar to FIG. 1 except that the display case is being operated in a defrost cycle of operation.

Display case 2 can be defrosted utilizing an ambient air flow by reversing the direction of operation of fan 26. When the air flow is reversed, air is expelled from air conduit 18 through opening 22 and such air flows in a direction away from the display case. Consequently no air curtain is established across opening 10 in display case 2. As fan 26 propels air in a reverse direction through the air conduits, a partial vacuum is created in the top portions of the air conduits thereby drawing ambient air into air conduits 18 and 28 through openings 20 and 30. This ambient air is then circulated through the air conduits and serves to defrost evaporator coils 24. The ambient air flowing through air conduit 28 assist in the defrosting of evaporator coils 24 in several ways. First, a portion of the ambient air will flow over lower portion 36 of evaporator coils 24. In addition, heat is transferred from the ambient air flow through conduit 28 to the air flow through conduit 18 that contacts the evaporator coils both by conduction and convection. The various air flow patterns during the defrost operation are shown in FIG. 2.

By properly positioning partition wall 34, it is possible to improve the operational performance of the refrigerated display case. The actual positioning of partition wall 34, in particular the space that is left between the end of partition wall 34 and the end of the evaporator coils, will vary in dependence upon the temperature of the display case, the sizes of the air conduits and the quantity of air being propelled through the conduits. This space, however, should preferably be at least a few inches.

Figure 3:
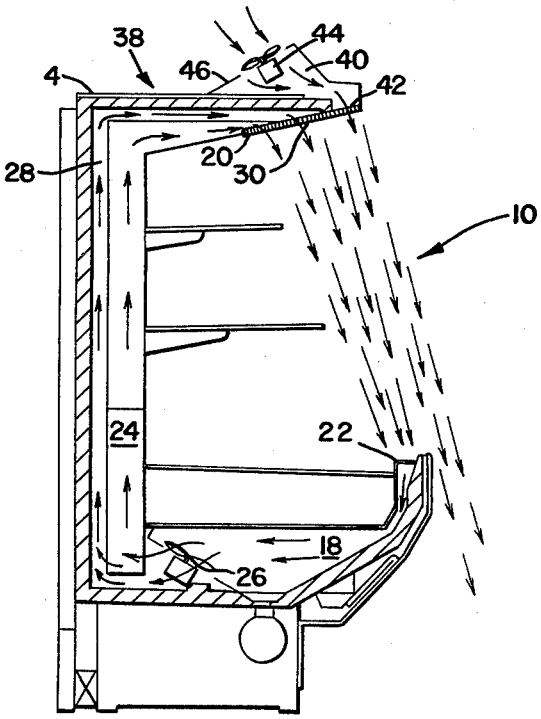
FIG. 3 is a side elevational partial sectional view of another embodiment of an open front refrigerated display case in accordance with the present invention with the case being operated in a refrigeration cycle of operation.

A modified embodiment of an open front refrigerated display case 38 is shown in FIG. 3. Display case 38 has an additional air curtain that is established across access opening 10. As shown in FIG. 3, case 38 is operating in a refrigeration mode of operation. This additional air curtain is a curtain of ambient air which further serves to improve the temperature gradient differential across the access opening. Such ambient air flow can be established by providing a tertiary conduit 40 with an outlet opening 42 and an inlet opening 46. Fan 44 draws ambient air into conduit 40 through inlet 46 and expells such air through outlet 42 in a laminar air flow across access opening 10.

Figure 4:
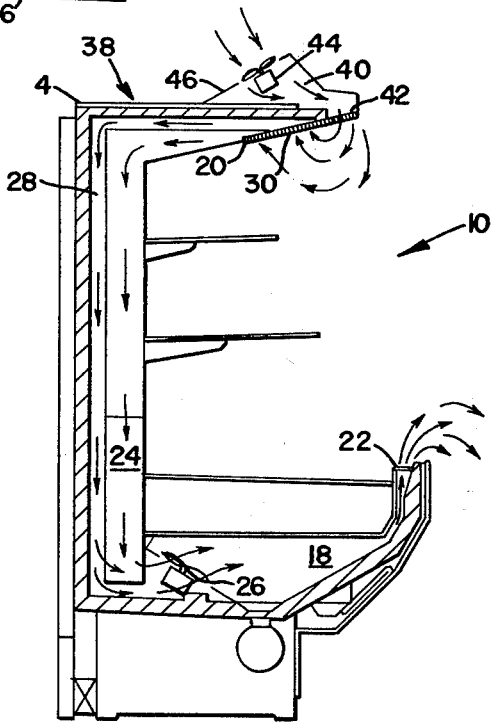
FIG. 4 is a view similar to FIG. 3 except that the display case is being operated in a defrost cycle of operation.

During a defrost cycle of operation, the ambient air flow through tertiary conduit 40 is maintained. The ambient air expelled from conduit 40 through outlet 42, however, is at least partially drawn into air conduits 18 and 28 which are drawing, in ambient air for defrosting evaporator coils 24. If the suction force created at openings 20 and 30 is large enough, then all of the ambient air flowing out of conduit 40 will be drawn into conduits 18 and 28. Such an air flow during a defrost operation of display case 38 is shown in FIG. 4. The actual defrost operation by the ambient air flowing through conduits 18 and 28 of display case 38 is the same as described above with respect to display case 2 as illustrated in FIG. 2.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What I claim is:

1. A refrigerated display case for displaying refrigerated products, said display case comprising:

a cabinet having an interior display space and an access opening for enabling access to refrigerated products within said display case;

a first air conduit extending around said cabinet so as to have an inlet opening at one end of said access opening and an outlet opening at the other end of said access opening, said inlet and outlet openings being aligned so that air leaving said outlet opening is directed across said access opening and received by said inlet opening;

refrigeration means arranged within said first air conduit for refrigerating air passing through said first air conduit by contact with refrigeration coils located therein;

air circulating means arranged within said first air conduit for circulating air through said first air conduit in a forward direction during a refrigeration cycle or operation so that air is expelled from said outlet opening, travels across said access opening and returns into said first air conduit through said inlet opening;

a second air conduit extending partially around said cabinet in a position lying outlwardly from said first air conduit, said second air conduit having an outlet opening arranged adjacent to the outlet opening of said first air conduit;

said refrigeration means having a lower part of the refrigeration coils thereof located in an upstream air flow position to the inner portion of said second air conduit; and said second air conduit having an air inlet opening located downstream from said lower part of said refrigeration coils so that during a refrigeration cycle of operation such inlet opening receives two portions of air passing through said first air conduit with only a first inner portion of such air having passed over said lower refrigeration coils part of said refrigeration means and with a second outer portion of air flowing directly from said first air conduit into said second air conduit without passage through said lower refrigeration coils so that the air flowing out of said second conduit and across said second opening at a distance spaced below said outlet opening of said second air conduit has a temperature gradient with the inner portion of such air flow being substantially colder than the outer portion and being at a lower temperature than in the absence of contact with said lower part of said refrigeration coils.

2. A refrigerated display case for displaying refrigerated products, said display case comprising:

a cabinet having an interior display space and an access opening for enabling access to refrigerated products within said display case;

a first air conduit extending around said cabinet so as to have an inlet opening at one end of said access opening and an outlet opening at the other end of said access opening, said inlet and outlet openings being aligned so that air leaving said outlet opening is directed across said access opening and received by said inlet opening;

refrigeration means arranged within said first air conduit for refrigerating air passing through said first air conduit by contact with refrigeration coils located therein;

air circulating means arranged within said first air conduit for circulating air through said first air conduit in a forward direction during a refrigeration cycle of operation so that air is expelled from said outlet opening, travels across said access opening and returns into said first air conduit through said inlet opening and for circulating such air in a reverse direction during a defrost cycle of operation so that air is expelled through said inlet opening;

a second air conduit extending partially around said cabinet in a position lying outwardly of said first air conduit, said second air conduit having an outlet opening arranged adjacent to said outlet opening of said first air conduit;

said refrigeration means having a lower part of the refrigeration coils thereof located in an upstream air flow position to the inner portion of said second air conduit; and said second air conduit having an air inlet opening located downstream from said lower part of said refrigeration coils so that during a refrigeration cycle of operation such inlet opening receives two portions of air passing through said first air conduit with only a first inner portion of such air having passed over said lower refrigeration coils part of said refrigeration means and with a second outer portion of air flowing directly from said first air conduit into said second air conduit. without passage through said lower refrigeration coils so that the air flowing out of said second air conduit and across said access opening at a distance spaced below said outlet openings has a temperature gradient with the inner portion of such air flow being substantially colder than the outer portion and being at a lower temperature than in absence of contact with said lower part of said refrigeration coils.

3. A refrigerated display case according to claim 1 or 2 wherein said air inlet to said second air conduit is appropriately positioned with respect to said refrigeration means so that the temperature of the air flowing through said second air conduit varies over an approximately 10° F. gradient from the inner portion of such flow to the outer portion of such flow.

4. A refrigerated display case according to claim 3 wherein said air inlet to said second air conduit is approximately positioned with respect to said refrigeration means so that the moisture of the air flowing through varies through said second air conduit with the inner portion of such flow having a lower level of moisture concentration and the outer portion of such flowing having a higher level of moisture concentration.

5. A refrigerated display case according to claim 4 wherein the variance in the moisture concentration of the air flow through said second air conduit between the inner portion of such flow and the outer portion of such flow is approximately 0.0024 lb. $H_2O$/lb. dry air.

6. A refrigerated display case according to claim 1 or 2 wherein said air inlet to said second air conduit is appropriately positioned with respect to said refrigeration means so that the moisture of the air flowing through said second air conduit varies with the inner portion of such flow having a lower level of moisture concentration and the out portion of such flow having a higher level of moisture concentration.

7. A refrigerated display case according to claim 2 further comprising: control means for switching between a refrigeration cycle of operation and a defrost cycle of operation and during such defrost cycle of operation temporarily terminating the operation of said refrigeration means and causing said air circulating means to circulate air through said first air conduit in a reverse direction for causing ambient air to be drawn into said outlet openings of said first and second air conduits and circulated through said first and second air conduits.

8. A refrigerated display case according to claim 2 wherein said access opening is located in a front wall of said cabinet.

9. A refrigerated display case according to claim 2 further comprising a third air conduit lying outwardly of said second air conduit and having an outlet opening for directing air along a path lying outwardly of the air emitted from said outlet openings of said first air conduit and said second air conduit and said third air conduit having an inlet opening for drawing in ambient air for passage through said third air conduit.

10. A refrigerated display case according to claim 7 or 9 wherein during a defrost cycle of operation, the air flowing through said first air conduit is emitted from said first air conduit through said inlet opening of said first air conduit in a direction away from said display case and said second air conduit is arranged so that the ambient air flowing through said second air conduit during a defrost cycle of operation assists in the defrosting of said refrigeration means by transferring heat to the air flowing through said first air conduit by conduction and convection.

11. A refrigerated display case according to claim 1 further comprising a third air conduit lying outwardly of said second air conduit and having an outlet opening for directing air along a path lying outwardly of the air emitted from said outlet openings of said first air conduit and said second air conduit and said third air conduit having an inlet opening for drawing in ambient air for passage through said third air conduit.

12. A refrigerated display case according to claim 1 or 11 wherein during a defrost cycle of operation, the air flowing through said first air conduit is emitted from said first air conduit through said inlet opening of said first air conduit in a direction away from said display case and said second air conduit is arranged so that the ambient air flowing through said second air conduit during a defrost cycle of operation assists in the defrosting of said refrigeration means by transferring heat to the air flowing through said first air conduit by conduction and convection.

13. A refrigerated display case according to claim 9 or 11 wherein said air inlet to said second air conduit is appropriately positioned with respect to said refrigeration means so that the temperature of the air flowing through said second air conduit varies over an approximately 10° F. gradient from the inner portion of such flow to the outer portion of such flow.

14. A refrigerated display case according to claim 13 wherein said air inlet to said second air conduit is appropriately positioned with respect to said refrigeration means so that the moisture of the air flowing through varies through said second air conduit with the inner portion of such flow having a lower level of moisture concentration and the out portion of such flowing having a higher level of moisture concentration.

15. A refrigerated display case according to claim 14 wherein the variance in the moisture concentration of the air flow through said second air conduit between the inner portion of such flow and the outer portion of such flow is approximately 0.0024 lb. $H_2O$/lb. dry air.

16. A refrigerated display case according to claim 9 or 11 wherein said air inlet to said second air conduit is appropriately positioned with respect to said refrigeration means so that the moisture of the air flowing through varies through said second air conduit with the inner portion of such flow having a lower level of moisture concentration and the out portion of such flowing having a higher level of moisture concentration.

17. A refrigerated display case according to claim 1 or 2 further comprising means arranged within said second air conduit for partially restricting the flow of air therethrough during a refrigeration cycle of operation such that the resistance to such air flow is at least as great as the resistance to air flow through said refrigeration means in said first air conduit when said refrigeration means is substantially free of frost buildup.

18. A refrigerated display case according to claim 2 or 7 wherein said air circulating means includes at least one fan arranged within said first air conduit and said fan is arranged so that during a defrost cycle of operation it draws in air through said outlet openings of said first air conduit and said second air conduit for circulation through said first air conduit and said second air conduit.

19. A refrigerated display case according to claim 2 or 7 wherein said first air conduit and said second air conduit are constructed such that the volume of air flowing through said second air conduit during at least a portion of a defrost cycle of operation is greater than the volume of air flowing through said second air conduit during a refrigeration cycle of operation.

20. A refrigerated display case according to claim 2 or 7 wherein said first air conduit and said second air conduit are constructed such that during a refrigeration cycle of operation, the volume of air flowing through said second air conduit is approximately one-third of the volume of air flowing through said first air conduit and during a defrost cycle of operation the volume of air flowing through said second air conduit is at least one-half of the volume of air flowing through said first air conduit.

21. A refrigerated display case according to claim 2 or 7 wherein said air circulating means causes a lower total volume of air flow through said first and second air conduits during a defrost cycle of operation than during a refrigeration cycle of operation.

22. A refrigerated display case according to claim 2 or 7 wherein said refrigeration means includes an evaporator coils and said inlet opening of said second air conduit is positioned such that a reverse air flow through said second air conduit during a defrost cycle of operation will flow in contact with a portion of said evaporator coil of said refrigeration means.

23. A refrigeration display case according to claim 1 or 2 wherein said refrigeration means includes an evaporator coil and further comprising a second evaporator coil arranged within said first air conduit in a location prior to said inlet opening of said second air conduit.

24. A method of operating a refrigerated display case for displaying refrigerated products where the display case includes a cabinet having an interior display space and an access opening for enabling access to refrigerated products within the display case, a first air conduit extending around the cabinet and having inlet and outlet openings at opposing ends of the access opening, an evaporator coil arranged within the first air conduit for refrigerating the air passing through such conduit, at least one fan for circulating air through the conduit, a second air conduit extending partially around the cabinet in a position lying outwardly of the first air conduit and having an outlet opening arranged adjacent to the outlet opening of the first air conduit and an inlet opening arranged so that during a refrigeration cycle of operation such inlet opening receives air passing through the first air conduit with a portion of such air having passed over a part of the evaporator coil; said method comprising the steps of:

circulating air in a first direction through the first air conduit and circulating two portions of air in the second air conduit during a refrigeration cycle of operation so that the air portions are expelled from the outlet openings of the first and second air conduits and returned to the first air conduit through its inlet opening;

refrigerating the air circulating through the first air conduit after such air has passed the location of the inlet to the second air conduit during a refrigeration cycle of operation;

cooling only the inner portion of the air flowing into and through the second air conduit by contact with the evaporator coil so that such a flow when leaving said second air conduit at a distance spaced below said outlet openings has a temperature gradient with the inner portion of such flow across said access opening being of a substantially lower temperature than the outer portion and being at a lower temperature than in the absence of contact with the evaporator coil; and circulating the outer portion of the air flowing into and through the second air conduit without passage thereof through the part of the evaporator coil through which the inner portion of air in the second air conduit flows.

25. A method according to claim 24 wherein a moisture gradient in the air flow through the second air conduit is created with the inner portion of such flow having a lower level of concentration of moisture than the outer portion of such flow.

26. A method according to claim 25 wherein approximately a 10° F. temperature gradient is created in the second air conduit during a refrigeration cycle.

27. A method according to claim 26 wherein the temperature of the air flowing through the first air conduit is approximately 30° F. and the temperature of the air flowing through the second air conduit varies from approximately 40° F. to 50° F.

28. A method according to claim 26 wherein there is a moisture gradient of approximately 0.0026 lb. $H_2O$/lb. dry air in the air flow in the second air conduit.

29. A method according to claim 24, 25, or 26, further comprising the steps of: circulating air through the first air conduit and the second air conduit in a reverse direction, temporarily terminating the operation of refrigerating the air during a defrost cycle of operation and causing ambient air to be drawn into the outlet openings of the first air conduit and the second air conduit for defrosting the evaporator coil; and transferring heat from the ambient air passing through the second air conduit to the air passing through the first air conduit during a defrost cycle of operation by conduction and convection.

30. A method according to claim 29 wherein the volume of air flowing through the second air conduit during at least a portion of a defrost cycle of operation is greater than the volume of air flowing through the second air conduit during a refrigeration cycle of operation.

31. A method according to claim 29 wherein the the volume of air flowing through the second air conduit during a refrigeration cycle of operation is approximately one-third of the volume of air flowing through the first air conduit during a refrigeration cycle of operation and the volume of air flowing through the second air conduit during a defrost cycle of operation is at least one-half of the volume of air flowing through the first air conduit during a defrost cycle of operation.

32. A method according to claim 29 wherein the total volume of air flowing through the first and second air conduits during a defrost cycle of operation is less than the total volume of air flowing through the first and second air conduits during a refrigeration cycle of operation.

33. A method according to claim 29 wherein a portion of the reverse air flow through the second air conduit flows in contact with a portion of the evaporator coil for defrosting such coil.

34. A refrigerated display case for displaying refrigerated products, said display case comprising:

a cabinet having an interior display space and an access opening for enabling access to refrigerated products within said display case;

a first air conduit extending around said cabinet so as to have an inlet opening at one end of said access opening and an outlet opening at the other end of said access opening, said inlet and outlet openings being aligned so that air leaving said outlet opening is directed across said access opening and received by said inlet opening;

refrigeration means arranged within said first air conduit for refrigerating air passing through said first air conduit by contact with refrigeration coils located therein;

air circulating means arranged within said first air conduit for circulating air through said first air conduit in a forward direction during a refrigeration cycle of operation so that air is expelled from said outlet opening, travels across said access opening and returns into said first air conduit through said inlet opening and for circulating such air in a reverse direction during a defrost cycle of operation so that air is expelled through said inlet opening;

a second air conduit extending partially around said cabinet in a position lying outwardly of said first air conduit, said second air conduit having an outlet opening arranged adjacent to said outlet opening of said first air conduit;

said refrigration means having a lower part of the refrigeration coils thereof located in an upstream air flow position to the inner portion of said second air conduit; and said second air conduit having an air inlet opening located downstream from said lower part of said refrigeration coils so that during a refrigeration cycle of operation such inlet opening receives two portions of air passing through said first air conduit with only a first inner portion of such air having passed over said lower refrigeration coils part of said refrigeration means, substantially all of said refrigeration means and with a second outer portion of air flowing directly from said first air conduit into said second air conduit without passage through said lower refrigeration coils so that the air flowing out of said second air conduit and across said access opening has a substantial temperature gradient with the inner portion of such air flow being substantially colder than the outer portion and being at a lower temperature than in absence of contact with said lower portion of said refrigeration coils;

control means for switching between a refrigeration cycle of operation and a defrost cycle of operation and during such defrost cycle of operation temporarily terminating the operation of said refrigeration means and causing said air circulating means to circulate air through said first air conduit in a reverse direction for causing ambient air to be drawn into said outlet openings of said first and second air conduits; and said second air conduit arranged so that the ambient air flowing through said second air conduit during a defrost cycle of operation assists in the defrosting of said refrigeration means by transferring heat to the air flowing through said first air conduit by conduction and convection.

35. A refrigerated display case according to claim 34 wherein during a defrost cycle of operation, the air flowing through said first air conduit is emitted from said first air conduit through said inlet opening of said first air conduit in a direction away from said display case.

36. A refrigerated display case according to claim 35 further comprising means arranged within said second air conduit for partially restricting the flow of air therethrough during a refrigeration cycle of operation such that the resistance to such air flow is at least as great as the resistance to air flow through said refrigeration means in said first air conduit when said refrigeration means is substantially free of frost buildup.

37. A refrigerated display case according to claim 34 wherein said air circulating means includes at least one fan arranged within said first air conduit and said fan is arranged so that during a defrost cycle of operation it draws in air through said outlet openings of said first air conduit and said second air conduit for circulation through said first air conduit and said second air conduit.

38. A refrigerated display case according to claim 37 wherein said first air conduit and said second air conduit are constructed such that the volume of air flowing through said second air conduit during at least a portion of a defrost cycle of operation is greater than the volume of air flowing through said second air conduit during a refrigeration cycle of operation.

* * * * *

UNITED STATES PATENT AND TRADEMARK OFFICE

CERTIFICATE OF CORRECTION

PATENT NO. : 4,389,852

DATED : June 28, 1983

INVENTOR(S) : Fayez F. Ibrahim

It is certified that error appears in the above-identified patent and that said Letters Patent is hereby corrected as shown below:

Please change the name of the inventor on the Cover page from "Fayez F. Abraham" to ---Fayez F. Ibrahim---.

Signed and Sealed this

*Seventh* Day of *May 1985*

[SEAL]

*Attest:*

DONALD J. QUIGG

*Attesting Officer* *Acting Commissioner of Patents and Trademarks*